US009920597B2

(12) United States Patent
Homstvedt et al.

(10) Patent No.: US 9,920,597 B2
(45) Date of Patent: Mar. 20, 2018

(54) SYSTEM FOR SUBSEA PUMPING OR COMPRESSING

(71) Applicant: Aker Solutions AS, Lysaker (NO)

(72) Inventors: Gunder Homstvedt, Houston, TX (US); Martin Pedersen, Oslo (NO); Rikhard Bjørgum, Eiksmarka (NO)

(73) Assignee: Aker Solutions AS, Lysaker (NO)

( * ) Notice: Subject to any disclaimer, the term of this patent is extended or adjusted under 35 U.S.C. 154(b) by 0 days.

(21) Appl. No.: 15/320,463

(22) PCT Filed: Jan. 30, 2015

(86) PCT No.: PCT/NO2015/050021

§ 371 (c)(1),
(2) Date: Dec. 20, 2016

(87) PCT Pub. No.: WO2015/199546

PCT Pub. Date: Dec. 30, 2015

(65) Prior Publication Data

US 2017/0159411 A1 Jun. 8, 2017

(30) Foreign Application Priority Data

Jun. 24, 2014 (NO) ..... 20140808

(51) Int. Cl.
*E21B 43/01* (2006.01)
*E21B 34/06* (2006.01)
*E21B 43/12* (2006.01)

(52) U.S. Cl.
CPC ..... *E21B 43/01* (2013.01); *E21B 34/066* (2013.01); *E21B 43/128* (2013.01)

(58) Field of Classification Search
CPC .... F04D 13/086; F04D 13/08; E21B 41/0007; E21B 43/00; E21B 43/20; E21B 34/066; E21B 43/01; E21B 43/128
(Continued)

(56) References Cited

U.S. PATENT DOCUMENTS 5,203,682 A * 4/1993 Inklebarger ..... E21B 43/00 417/252
5,417,553 A * 5/1995 Gibson ..... F04B 53/00 417/366
(Continued)

FOREIGN PATENT DOCUMENTS

GB 2457784 A 9/2009

OTHER PUBLICATIONS

International Search Report and Written Opinion issued in related Application No. PCT/NO2015/050021, dated Sep. 9, 2015 (8 pages).
(Continued)

*Primary Examiner* — James G Sayre
(74) *Attorney, Agent, or Firm* — Baker Botts L.L.P.

(57) ABSTRACT

A system for subsea pumping or compressing includes an ESP (electrical submersible pump), a flowline jumper, a connector part in either end of the flowline jumper, and a truss structure or longitudinal rib-arrangement that acts as a stiffening arrangement. The ESP may be arranged in the flowline jumper which may be orientated in a substantially horizontal direction. The stiffening arrangement may function to ensure that the ESP shaft is straight at all times during lifting, installation and operation. The system may also include a load limiting arrangement for limiting or eliminating the load on structure and seabed supporting the system.

20 Claims, 9 Drawing Sheets

Figure 1:
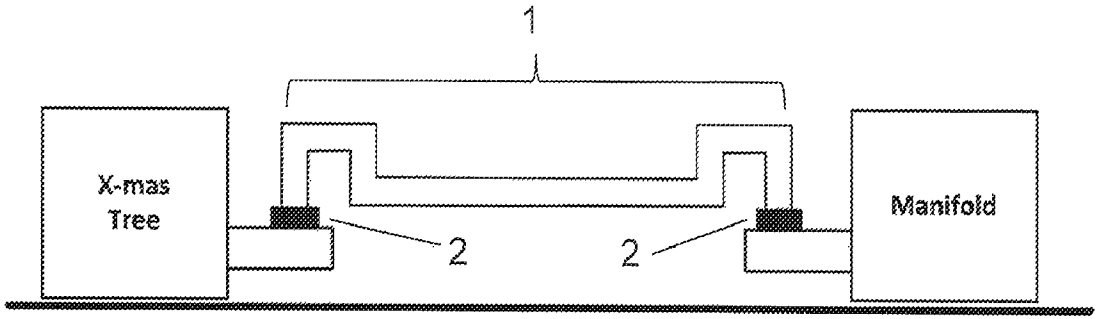
Figure 1 PRIOR ART

(58) Field of Classification Search
USPC ..... 166/351
See application file for complete search history.

(56) References Cited

U.S. PATENT DOCUMENTS

| | | | | |
|---|---|---|---|---|
| 5,518,340 | A * | 5/1996 | Hall | F16L 3/00 138/97 |
| 7,565,932 | B2 | 7/2009 | Lawson | |
| 8,382,457 | B2 * | 2/2013 | Wilson | E21B 41/0007 417/423.15 |
| 8,961,153 | B2 * | 2/2015 | Wilson | E21B 43/01 166/105 |
| 2009/0068037 | A1 * | 3/2009 | Shaw | E21B 43/128 417/423.3 |
| 2010/0119381 | A1 | 5/2010 | Scarsdale | |
| 2010/0119382 | A1 | 5/2010 | Scarsdale | |
| 2016/0010434 | A1 * | 1/2016 | Portman | F04B 47/06 166/360 |

OTHER PUBLICATIONS

Search Report issued in related Norwegian Application No. 20140808, dated Jan. 22, 2015 (2 pages).

* cited by examiner

SYSTEM FOR SUBSEA PUMPING OR COMPRESSING

CROSS-REFERENCE TO RELATED APPLICATION

The present application is a U.S. National Stage Application of International Application No. PCT/NO2015/050021 filed Jan. 30, 2015, which claims priority to NO Application No. 20140808 filed Jun. 24, 2014, both of which are incorporated herein by reference in their entirety for all purposes.

FIELD OF THE INVENTION

The present invention relates to subsea tie-in, subsea production and subsea pressure boosting of hydrocarbons or other subsea flows handled in the petroleum industry. More specifically, the invention relates to a system for subsea pumping or compressing, comprising an Electric Submersible Pump (ESP).

BACKGROUND OF THE INVENTION AND PRIOR ART

A subsea pump, according to normal terminology in the art, is a pump designed to be operated as located on or close to the seabed. Accordingly, subsea pumping means pumping with subsea pumps arranged on or close to the seabed. In contrast, an Electric Submerged Pump (ESP) is according to normal terminology in the art a downhole pump to be arranged downhole into a wellbore for downhole pumping. Corresponding terminology can be used for compressors. Correspondingly, a subsea pressure booster is a subsea pump or compressor for subsea pressure boosting.

A demand exists for subsea pressure boosting for different applications.

Traditional subsea pumps are designed to handle rather large flow rates and high pressure boosting needs. Such pumps typically require supply of barrier fluid, extensive monitoring and manifold arrangements, making installations with such pumps complex, large, heavy and costly to fabricate and install.

For cases where there is a need to boost low flow rates, from a single well or a few wells, various attempts to applying downhole pumps—so called Electrical Submerged Pumps (ESP)—at the seabed have been tried. Such pumps have widespread application for artificial lift from wells as placed down in the wellbore. These pumps are driven by an electric motor powered through a cable clamped to the production tubing. They are mature machines with extensive track records, commercially available from a number of suppliers, Schlumberger and Baker Hughes being the biggest. Since they are designed to be placed in a slim well bore, they are long and skinny. Length can be up to 40 meter and total installed power can be up to and above 1 MW, typically about 20 m length and about 1 MW installed power.

One arrangement of placing ESPs on the seabed is described in U.S. Pat. No. 7,565,932, "Subsea flowline jumper containing ESP" by Baker Hughes Inc. The patent describes the basic concept of installing an ESP in a generally horizontal section of a flowline jumper. Such flowline jumpers are typically used to connect various units in a subsea production system, the flowline jumpers having a vertical connector in each end. By exchanging the horizontal pipe section of the flowline jumper with an enlarged section containing an ESP, ease of installation can be achieved.

In U.S. Pat. No. 7,516,795, "Subsea Petroleum Production System Method of Installation and Use of the Same", by Petrobras, it has been described a subsea pumping system where pipe-mounted ESPs are assembled in a cassette. The ESPs are connected in series and mounted at an angle of up to 5 degrees from horizontal. The cassette is mounted onto a flow base. The cassette and the flow base can be installed via cable from service vessels in order to reduce time and cost.

Another arrangement is described in the U.S. Pat. No. 8,500,419 "Subsea pumping system with interchangeable pumping units", by Schlumberger. This patent describes a similar arrangement of one or more ESPs in generally horizontal subsea pipe sections. Said patent describes a pumping module containing one or several pumping units mounted on a skid. The pump units, each having electric driven pumps (ESPs) assembled in a tubular section, can be individually retrieved. The pump skid includes a number of additional sub-systems: controller, sensor, pipe mount, hydraulic/electrical connectors, isolation valves and at least one fluid by-pass valve.

The U.S. Pat. No. 8,083,501 "Subsea pumping system including a skid with mate-able electrical and hydraulic connections", also by Schlumberger, describes a more generalized version of the system described in patent U.S. Pat. No. 8,500,419. The two patents are filed at the same date. U.S. Pat. No. 8,083,501 has the same arrangement as U.S. Pat. No. 8,083,419, but describes a self-contained horizontal pump module, containing a centrifugal pump driven by an electrical motor. The description covers electric driven horizontal pumps in general—assembled in a pressure containing housing on a skid.

Pumps that are long and slim due to their intended application in a wellbore, are not ideal for subsea use. Typical subsea pumps are in contrast more compact and arranged for vertical installation and retrieval. A subsea pump is typically mounted on a flow base having a simple manifold arrangement for the routing of flow in and out of the pump plus allowing for by-pass in case of pump shutdown. U.S. Pat. Nos. 7,516,795, 8,500,419 and 8,083,501, mentioned above, describe typical subsea arrangement of the respective pumps mounted on a base. Such base is costly both to fabricate and install. Said pumps are arranged in a structure that adds weight and cost.

Subsea operations are expensive and equipment reliability is therefore one of the most vital selection criteria. Rotating equipment is in need of more frequent service than stationary equipment and reliability and serviceability should be given high priority in design.

ESPs have limited service life compared to subsea pumps, in part due to the design and in part due to the very challenging down-hole environment where they normally are installed. Typical interval for retrieval for service is 2-4 years.

However, if the arrangement described in the state of the art publication U.S. Pat. No. 7,565,932 could be further enhanced with respect to reliability, robustness, simplicity, cost and installation/retrieval, it would be beneficial for the petroleum industry and it would increase the use of ESPs subsea, on or close to the seabed.

The objective of the present invention is to improve the technology of the state of the art, as described in U.S. Pat. No. 7,565,932.

SUMMARY OF THE INVENTION

The invention provides a system for subsea pumping or compressing, comprising:

an ESP (electrical submersible pump), a flowline jumper, a connector part in either end of the flowline jumper, and an arrangement for lifting, the ESP has been arranged in the flowline jumper which has been orientated in substance horizontal. The system is distinctive in that it further comprises:

a stiffening arrangement, ensuring a straight ESP shaft at all times during lifting, installation and operation, and a load limiting arrangement for limiting or eliminating the load on structure and seabed supporting the system.

The term ESP means in this context a pump designed and typically used down into wellbores, as previously described. The phrase "flowline jumper which has been orientated in substance horizontal" means a horizontally orientated or slightly inclined flowline jumper. Slightly inclined means angle from horizontal orientation to less than 5°, 3°, 2° or 1° from horizontal. "In substance horizontal", "substantially horizontal" and "generally horizontal" has the same meaning in this context. For pressure boosting of liquid with some gas, the gas can be restricted in the flow inlet to the ESP by said inclination, and for pressure boosting of gas with some liquid, the liquid can be restricted. The flowline jumper has increased cross section area and wall thickness due to the ESP inside, compared to an ordinary flowline jumper without ESP. With the phrase "a stiffening arrangement, ensuring a straight ESP shaft at all times during lifting, installation and operation", it is meant sufficient stiffening to avoid shortened service life at lifting in air and lifting in water as in a normal installation procedure, as compared to the design service life without said lifting. With the phrase "a load limiting arrangement for limiting or eliminating the load on structure and seabed supporting the connectors", it is meant that the load is limited to the system having a weight not overloading substructure and soil, as compared to design load for an ordinary flowline jumper without an ESP and stiffening arrangement. The stiffening arrangement and the load limiting arrangement are arranged to the flowline jumper part of the system for providing straightness of the ESP shaft and load limiting, respectively, or combined as one structure providing both straightness of the ESP shaft and load limiting.

Preferably, the load limiting arrangement comprises buoyancy elements. Such elements are preferably made from syntactic foam having the required service life. Alternatively, a number of small tanks or pipe sections filled with gas or foam based buoyancy material can be used as buoyancy elements.

The buoyancy compensation is preferably 4-6 metric tons, since this is a typical additional weight of a system of the invention as compared to an ordinary flowline jumper. The load or weight compensation by the buoyancy material can however span from resulting in a system of approximately neutral buoyancy as installed and connected and down to 1 metric ton. If near neutral buoyancy is used, such as resulting in a system weight as submerged of less than 500 kg, weight elements can be included in the system during handling and installation, at least as immersed, after which installation the weight elements can be removed, which represents a preferable embodiment of the invention. Accordingly, a very low load on supporting structure and seabed can be achieved whilst still allowing effective installation.

Preferably, the stiffening arrangement comprises a truss structure or longitudinal ribs mounted or welded to the pipe containing the ESP, or both a truss structure and longitudinal ribs. At least three longitudinal rib structures arranged 120° apart around the circumference are convenient. An additional or alternative stiffening structure comprises one or more support legs arranged in the mid-section or along the jumper containing the ESP.

In a preferable embodiment, the load limiting arrangement and the stiffening arrangement are combined. Parallel gas filled or buoyancy material filled pipe sections or similar structure arranged to the flowline jumper providing stiffening and buoyancy with one structure is one example.

Preferably, each connector part or connector adapter comprises an isolation valve, to avoid leakage to the environment at installation, replacement or retrieval of the system.

The system can preferably comprise a separate by-pass line controlled by an electrically operated valve that closes when power is applied to the ESP.

The system may comprise an intermediate landing structure that can be mounted at locations where the jumper containing the ESP needs to be at an angle compared to the initial jumper to allow enough space for installation. The intermediate landing structure has preferably been adapted for installation of more than one flowline jumper containing ESPs, preferably the intermediate landing structure comprises manifolds and valves allowing routing of the flow. The intermediate landing structure preferably comprises one or more of: manifolds and valves allowing at least two ESPs to be run in parallel, manifolds and valves allowing at least two ESPs to be run in series, manifolds and valves for a by-pass pipe, the valves are preferably remotely activated valves.

The system of the invention provides subsea pressure boosting whilst eliminating the weight and cost of making a pump skid and enable reliable connection and isolation features. The system of the invention provides a relatively simple and cost effective pressure boosting, allowing use also where the supporting structure or seabed can tolerate no further loads, which is a very relevant issue in mature areas, often having soft soil seabeds overloaded by old, existing structure.

The system further enhances the application on a variety of subsea fields by utilizing intermediate, free standing landing structures to which the system can be connected. Connection to such landing structures can be done via flexible hoses, horizontal or vertical connections.

The system can further be used in areas where trawling protection is required by having the pipe-section located at or close to the sea floor. The system may comprise a protection mat placed above the pipe-section and a local protection structure at the connection hubs. In such areas, a horizontal tie-in and connection method will be used.

The system of the invention establishes an enhanced version of a subsea installed ESP based on the basic concept in U.S. Pat. No. 7,565,932 by solving the following key issues:

The increased weight of the installed ESPs, giving an additional load on the connector supports and other existing subsea structure in each end of the jumper, will be reduced or eliminated The risk of bending the pipe containing the ESP (due to the added weight) and thereby challenging the rotor-dynamic stability of the ESP motor-pump assembly, is eliminated The original, permanently installed connection hubs will typically lack isolation valves to contain hydrocarbons during installation and retrieval. Such modifications cannot be done to the permanent installed connector hubs. The system of the invention handles this issue.

If the existing field architecture/arrangement does not have the required horizontal distance between the existing connection hubs to allow installation of the system directly onto those connectors, the installation of the system can be done onto one or two intermediate landing hubs either pre-installed or landed with the jumper on the seabed close to the existing connection points.

Contrary to the systems of U.S. Pat. Nos. 7,516,795, 8,500,419 (pipes containing an ESP type pump unit) and U.S. Pat. No. 8,083,501 (a more generalized pump unit), all of which are mounted onto subsea skids and being complex, heavy and expensive, the system of the invention can utilize the existing foundations at the connection points, without overloading said connection points or supporting structure or seabed.

The system of the invention is lightweight, easy to install with minimum added equipment in, requiring only electric power supply in order to work as a boosting station. The seabed location provides better cooling of the ESP than downhole location and allows for shorter pumps with larger diameter, running at lower speed than down-hole versions, increasing reliability.

FIGURES

FIG. 1 gives a presentation of a typical flow-line jumper arrangement, not according to the invention.

FIGS. 2A, 2B, 3, 4, 5, 6, 7A-D, 8A-D and 9 illustrate embodiments of the system of the invention, or details thereof, as explained in detail below.

DETAILED DESCRIPTION

As illustration of background art, not according to the invention, FIG. 1 illustrates of a typical flow-line jumper arrangement (1) with vertical connector parts (2) in each end for connecting to a x-mas tree and with a manifold, respectively. Similar arrangement can also be made in a horizontal version. Horizontally made-up connectors will in such case be used instead of the vertical ones. Horizontal arrangements are typically used where trawling activity might be going on. The flowline will in such cases be trenched, located at or close to the seabed. A removable trawling protection mat or similar arrangement will typically be placed on top of the flow-line if it is not trenched.

Figure 2:
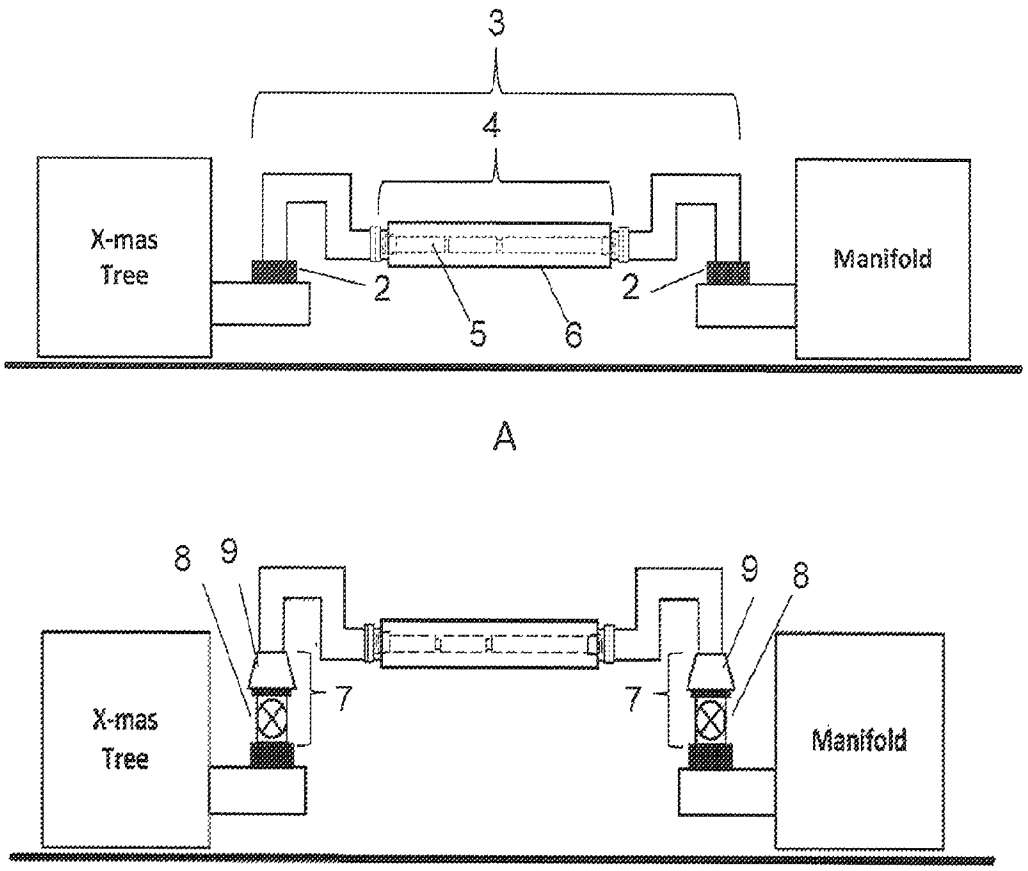

FIG. 2A illustrates a preferred embodiment of the invention where there is enough space between the connection points to directly replace the existing jumper with the new jumper assembly (3). The new jumper version has the same connector parts (2), but it has a new mid-section (4) that contains the ESP (5) inside a generally horizontal section of the flow-line (6). FIG. 2B illustrates a variation of the embodiment as for FIG. 2A, wherein each connector part comprises a connector adaptor (7) at each end of the new jumper, between the connector part of original design towards the X-mas tree and manifold, respectively, and the mid-section. This adaptor comprises an isolation valve (8) and a new connector with new connector part (9). The initial connector part is permanently left in place with the isolation valve when the mid-section with new connector parts is retrieved. This allows for closing the flow-line ahead of pulling the jumper to avoid spillage to sea. This solves an important issue related to replacing an existing jumper with an ESP-Jumper as such isolation valves are typically not in place in the existing system. This arrangement also allows for selecting a new connector that is optimally suited for quick and reliable retrieval and re-installation and standardization of required tooling.

Figure 3:
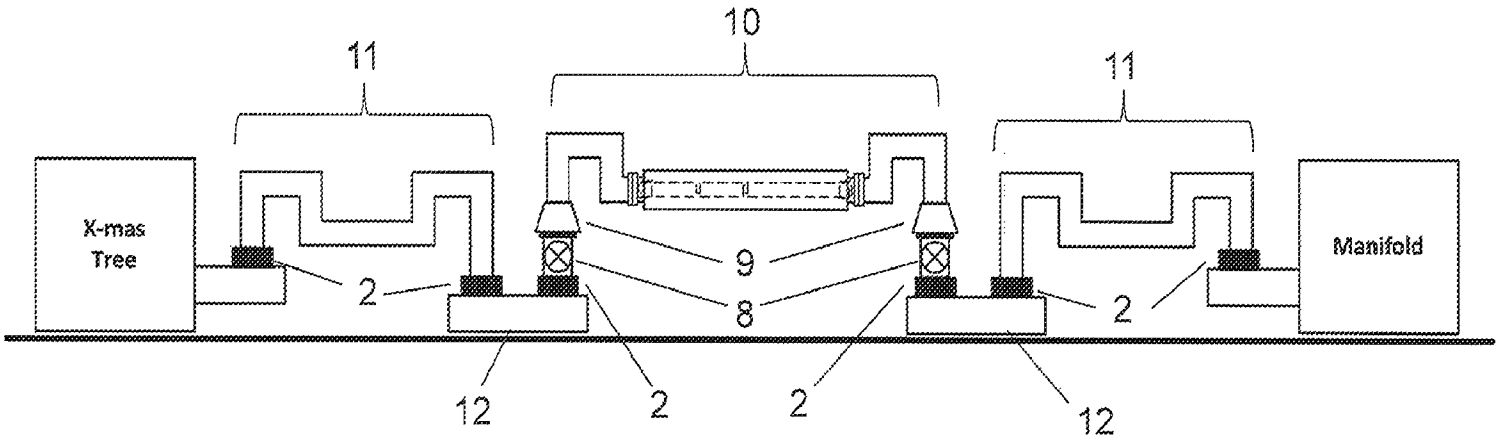

FIG. 3 illustrates another preferred embodiment of the invention. This version can be used in cases where there is not enough space between the connection points for direct replacement of the original jumper with a new ESP-jumper assembly (10). At least one intermediate landing structure (12) is in such case located between the original connection points. FIG. 3 is showing two such landing structures. Such structures are typically landed at the seabed on a mud-mat or similar foundations. They are having a simple manifold connecting the in and out-going flow. They can be arranged with isolation valves (8) and new connector parts (9) suitable for easy retrieval, re-landing and connecting the ESP-jumper (10). Suitable jumpers (11) are used in connecting the intermediate landing structures with the initial connection hubs. The jumpers 10 and 11 will typically be mounted at an angle to each other allowing more freedom to locate the equipment if the seabed space is limited in the area.

Figure 4:
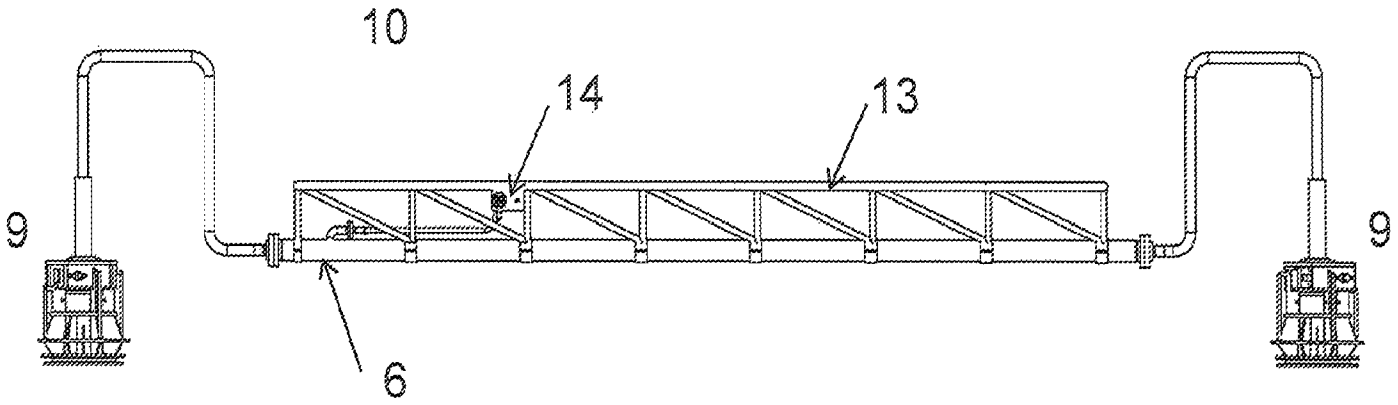

FIG. 4 illustrates an embodiment of the invention where the ESP-jumper (10) is equipped with a truss structure (13) to make the generally horizontal section of the jumper containing the ESP (6) stiff enough to avoid significant bending. Vertical connector parts (9) are mounted in each end. Wet-mate connector (14) for electric power feed to the ESP is mounted on the truss structure.

Figure 5:
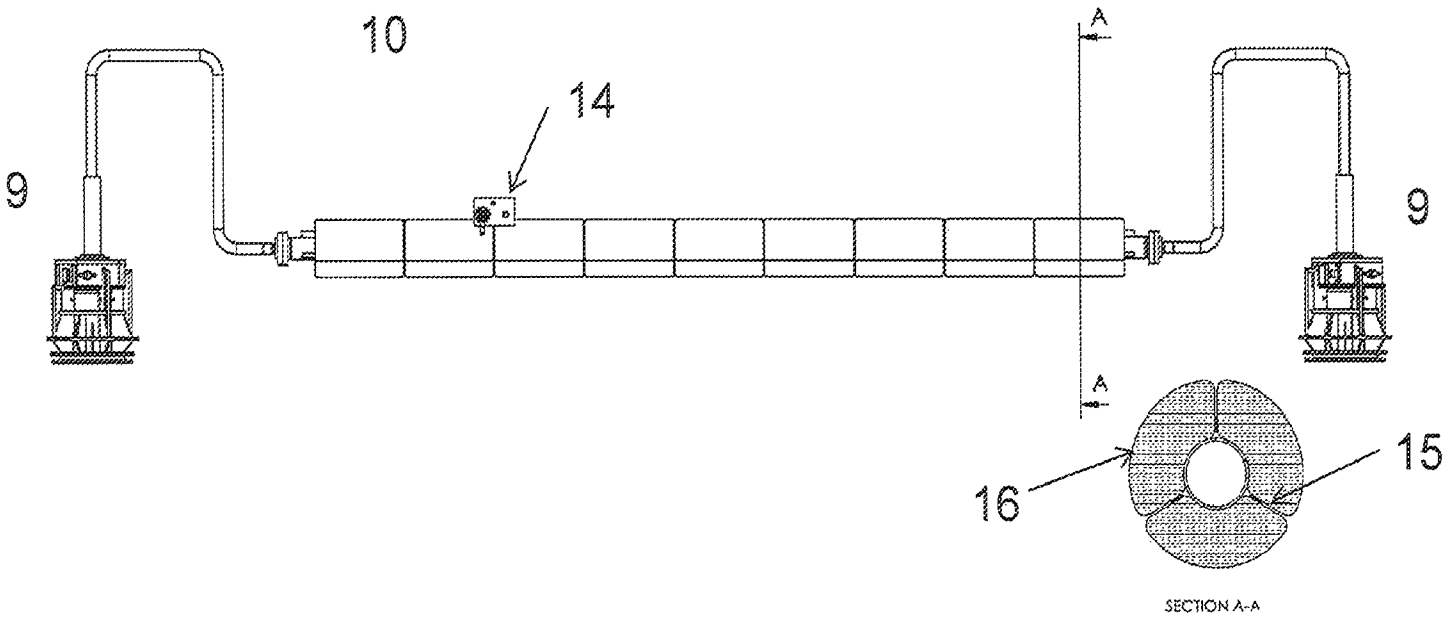

FIG. 5 illustrates an alternative embodiment of the invention where the ESP-jumper (10) is equipped with ribs (15) and buoyancy elements (16). Three such ribs are typically located 120 degrees apart to make the generally horizontal section of the jumper containing the ESP stiff enough to avoid significant bending. The ribs are typically covering the entire jumper pipe length and having a size that reduces bending to an acceptable level. Vertical connector parts (9) are mounted in each end. Wet-mate connector (14) for electric power feed to the ESP is mounted on one of the ribs. Buoyancy elements (16) are mounted between the ribs onto the ESP-pipe. The buoyancy elements are sized to compensate for the added weight by including the ESP and the large diameter pipe containing the pump. In this way the connection points see no significantly added weight compared to the initial loading.

Similar buoyancy elements can be mounted inside or attached to the truss structure shown in FIG. 4 for the same purpose as described here.

As a preferable embodiment, the load limiting of the system of the invention can be enhanced by adding more buoyancy, reducing the weight of the system to a value lower than the initial jumper load without an ESP, thereby increasing the structural integrity. This is particularly feasible for mature fields with overloaded support structure and fields with weak or unstable seabed. Additional weight required for efficient installation can preferably be a part of the lifting arrangement, and be retrieved after installation.

Figure 6:
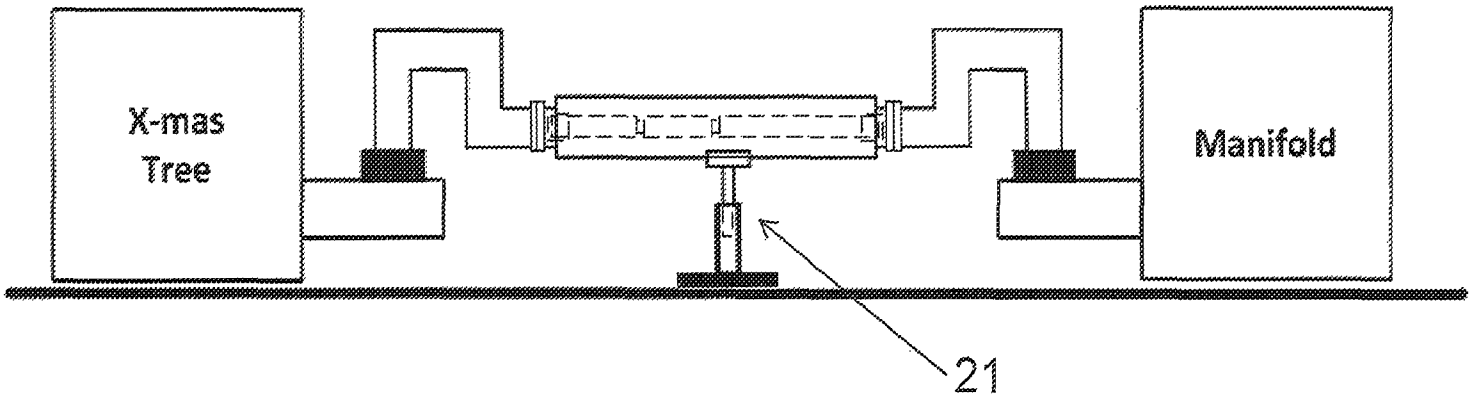

FIG. 6 illustrates an additional or alternative way of supporting jumpers containing an ESP to avoid sagging. The mid-section of the horizontal pipe comprises at least one supporting adjustable leg (21). The leg comprises a foundation resting on the seabed and can be adjusted to give proper support.

Figure 7:
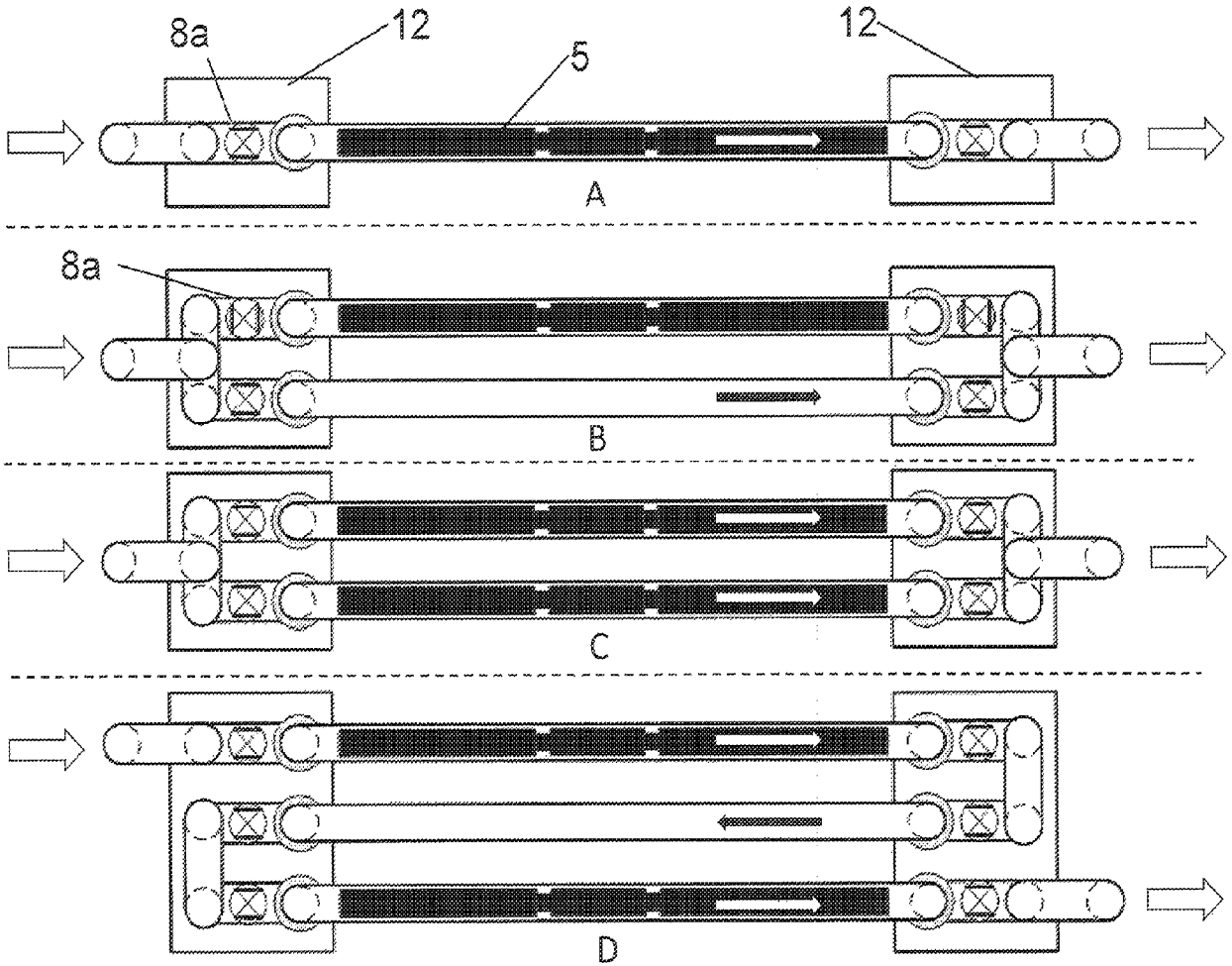

FIG. 7 illustrates four alternative arrangements of jumpers containing an ESP (5) landed onto two intermediate landing structures (12).

In FIG. 7A a single ESP-jumper is utilized. The isolation valve (8*a*) is set in open position during operation.

In FIG. 7B a single ESP-jumper is utilized in parallel with another pipe with no ESP. The pipe with no ESP can be utilized for by-pass if needed. If for example the ESP should be out of operation, the flow can be routed through this bypass pipe. The isolation valve (8*a*) for the pipe containing an ESP is set in closed position during bypass-operation. The bypass pipe can also allow for pigging through the system.

In FIG. 7C two ESP-jumpers are utilized in parallel for increased capacity. The isolation valves connected to the ESP-pipes are set in open position during operation.

In FIG. 7D two ESP-jumpers are connected in series for increased pressure boosting capacity. A third pipe, having no ESP, connecting the outlet of the first ESP with the inlet to the second ESP will allow this mode of operation. The isolation valves are set in open position during pumping.

Figure 8:
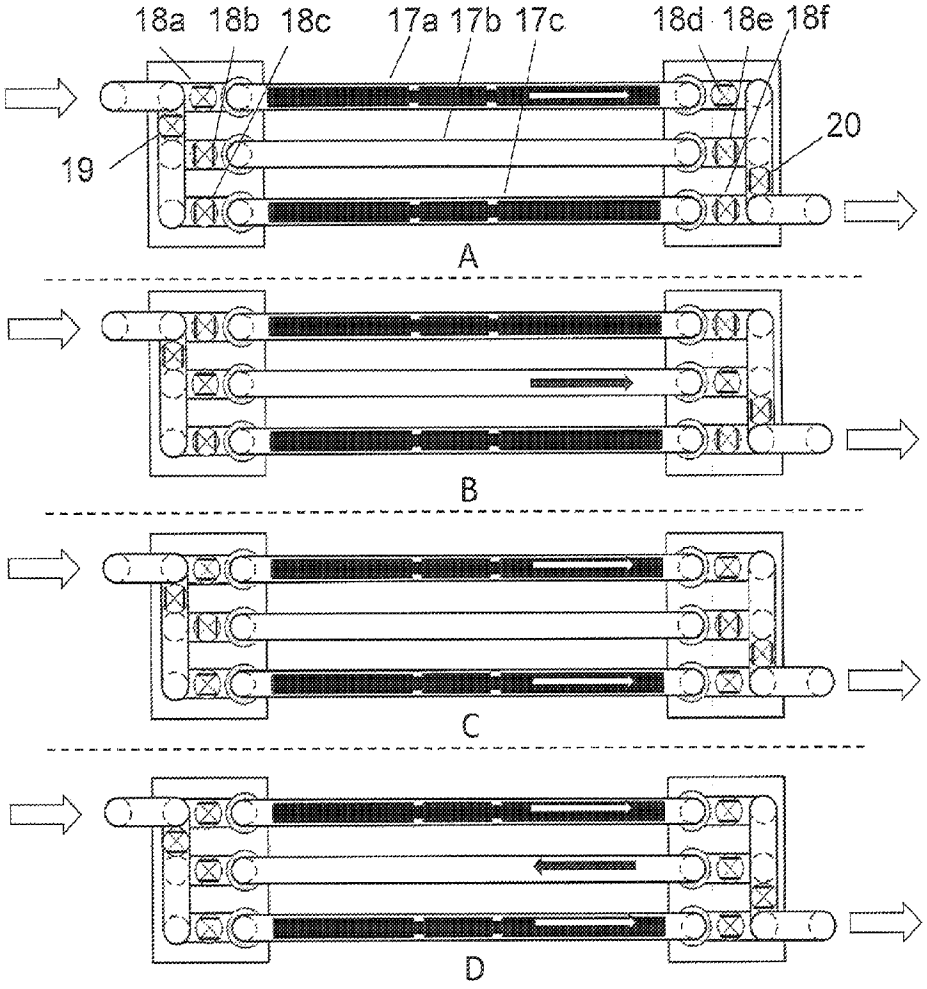

FIG. 8 illustrates an alternative arrangement where the manifolds at the intermediate landing structures are re-arranged to allow for various operation modes by changing valve position. Three pipes (17*a*, 17*b* and 17*c*) are arranged in parallel. Pipe 17*a* and 17*c* contain ESPs and pipe 17*b* serve as by-pass line. Isolation valves 18*a*, 18*b* and 18*c* are located at the inlet of each of the pipes, while isolation valves 18*d*, 18*e* and 18*f* are located at the respective outlets. Routing valve 19 is located in the inlet cross-connecting header between pipe number one and two (17*a* and 17*b*), while valve 20 is located in the outlet cross-connecting header between the outlets of pipe two and three (17*b* and 17*c*). A setup with three ESPs in parallel can also be arranged (not shown). The valves are typically remotely controlled for efficient re-routing of the flow.

FIG. 8A illustrates a single ESP operation. A second ESP can be installed as back up. The by-pass line and the back-up ESP are closed off. Valves 18*a*, 18*d* and 20 are open. The other valves are closed.

FIG. 8B illustrates a by-pass operation with no ESPs in operation. The two ESPs are closed off. Valves 19, 18*b*, 18*e* and 20 are open. The others are closed.

FIG. 8C illustrates a parallel operation of two ESPs. The by-pass is closed off. Valves 18*b* and 18*e* are closed. The other valves are open.

FIG. 8D illustrates serial operation of two ESPs. The by-pass line is used to connect the two ESPs. Valves 19 and 20 are closed, all other valves are open.

Figure 9:
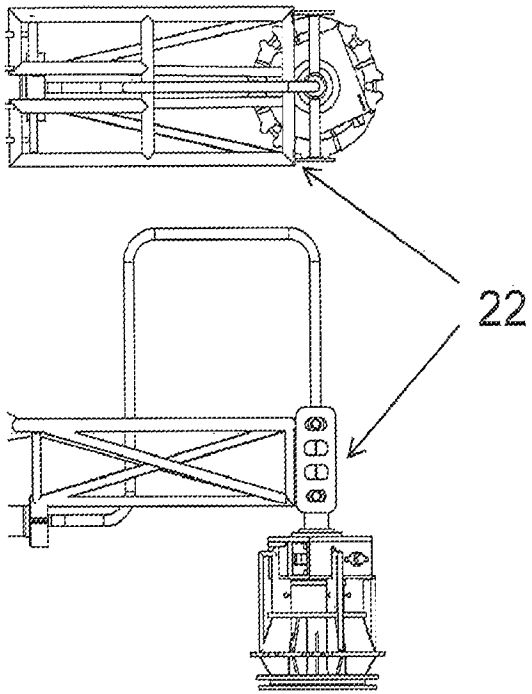

FIG. 9 illustrates a pipe support frame (22) typically mounted in each end of the jumpers illustrated in FIGS. 4 and 5. The frame allows for temperature induced expansion/contraction in the direction of the pipe axis. The frame will however transfer torque and load in the vertical direction onto the connector hub. Side-load (in the horizontal direction) induced typically by any ocean current at the location, will also be transferred.

With the present invention, the prior art limitations are remedied by one or more of the following changes:

The weight of the jumper is different in air and submerged in water. The stiffening arrangement and a proper lifting arrangement to secure a straight pipe during lifting will be arranged so that the pipe containing the ESP will see minimal bending during lifting in air and in water, installation and in the landed, operational position. Long pumps, like the ESP type, shall preferably be operated with a straight shaft. The rotor-dynamic behaviour of this long shaft going through the motor, seal section and pump benefits from the present invention. Minimizing oscillations and vibrations will minimize the wear and tear on bearings and seals and ensure long service life. Such shaft straightness will be achieved by a stiffening arrangement on the ESP-pipe. A truss structure or fins mounted onto the pipe are two possible arrangements.

A spreader-bar and wires from this bar connected to lifting points distributed along the jumper allows for keeping the jumper straight also during lifting in air and going through the splash-zone during installation.

In order to avoid additional weight on the landing structures and vertical connectors beyond the initial loading of these connectors, buoyancy elements are included as a load limiting arrangement. Such buoyancy elements will compensate for the added weight introduced by the ESP and the larger pipe containing it. The buoyancy elements and stiffening devices can be combined either in a truss structure or with stiffening fins attached to the pipe and embedded in the buoyancy materials, or the same structure can be both stiffening and load limiting.

A subsea jumper arrangement that has a generally horizontal section containing an ESP will require a certain distance between the connector hubs. If such distance is sufficient, the ESP-jumper can directly replace the existing jumper. If the distance is too short, one or two intermediate landing structures can be installed and the ESP-jumper is installed between the structures. One or two flow-line jumpers will in such case have to be installed between the initial connection hubs and the intermediate landing structures. The jumpers are installed at an angle to each other in the horizontal plane to allow for flexible routing and enough space for the ESP pipe. In fields where horizontal connector systems are used, the arrangement can be adapted for such connectors. Trawling protection can be added both on the horizontal pipe section and also for the intermediate landing structures where needed.

Connectors exist in various make requiring relevant subsea tools for installation and retrieval. The ESP-jumper might need more frequent change-out, typically every 2-4 years, than the pipeline jumper due to required pump service. Installing a quick-connect connector type for the ESP-jumper is therefore preferable, for standardizing and availability of required tools and efficient operation.

Isolation of the in- and out-board pipeline ends is vital to contain hydrocarbons from leaking to the environment when the ESP-jumper is retrieved. If the ESP-jumper is landed directly onto the original hubs, a connector adaptor including such isolation valve is preferably used. Such adaptor will typically be a complete connector housing permanently left in place on the existing connection hub and terminated at the upper end with the standardized vertical connector hub. An isolation valve is included in the adaptor between the connectors. Such valve is typically operated by a Remote Operated Vehicle (ROV). If the ESP-jumper is landed onto one or more intermediate landing structures, a small manifold with isolations valves can be included.

Flow by-pass can be achieved by having a pipe arranged in parallel with the ESP-pipe and the flow path controlled by valves. The valves can be ROV operated or remotely controlled by the production control system. The valves can also be electrically operated by the electric power fed to the ESP so that it will be set in the desired position when the ESP is powered.

The embodiment where the ESP-jumper is arranged onto two intermediate landing structures can accommodate serial or parallel operation of ESPs. Three parallel pipes arranged with valves in each ends of the pipes onto the manifold mounted on the structures can direct flow in various ways. Two pipes will typically be equipped with ESPs while the third is empty. The empty pipe is used for by-pass.

For all these embodiments and variations thereof, means are provided to allow for hydrate inhibition. Injection ports are installed at suitable locations for supply of methanol or other inhibitors. This arrangement will also be used for flushing of the unit to remove hydrocarbons prior to retrieval. Supply and control of such injection is typically provided from the associated production system. Valves and connectors of the system are preferably designed to allow override by ROV in case of control failure.

Condition monitoring of the ESP (pressure, temperature and vibration signals) can be done in several ways:

Signals modulated onto the power feed cable, as typically done for ESPs used in wells, can be applied if the data update frequency is not critical Signals can be routed through the production controls system Signals can be routed through a signal line or optical fiber in the ESP power umbilical.

As an example of the technical effect of the invention, a case study for a specific field in the Gulf of Mexico can be mentioned. For said field, an installed state of the art subsea pump system comprising 4 flowline jumpers with ESP for pressure boosting weights about 350 metric tons, including required substructure. A system of the invention, also comprising 4 flowline jumpers with ESP, providing identical pressure boosting, weighs about 60 metric tons, including required substructure. Accordingly, the weight reduction is about a factor 60/350, resulting in a weight of about 17% of the state of the art system, and it is reason to believe that also the cost reduction and reduced time for fabrication are accordingly. If comparison is made to traditional subsea pump systems, the technical effect is even more favorable.

For subsea fields with overloaded structure or unstable seabed or both, the system of the invention can be the only possible way of providing pressure boosting without building a completely new pressure boosting station for location on the seabed besides the existing structures.

The system of the invention may comprise any feature or step as here illustrated or described, in any operative combination, each such operative combination is an embodiment of the present invention.

The invention claimed is:

1. A system for subsea pumping or compressing, comprising:

a flowline jumper;

an ESP (electrical submersible pump) arranged in the flowline jumper;

a connector part in either end of the flowline jumper;

at least one of a truss structure and a longitudinal rib-arrangement configured as a stiffening arrangement to ensure a straight ESP shaft during lifting, installation, and operation; and a load limiting arrangement that comprises buoyancy elements.

2. The system according to claim 1, further comprising at least one isolation valve arranged in the connector part and configured to avoid leakage to the environment at installation, replacement or retrieval of the flowline jumper.

3. The system according to claim 1, further comprising a separate by-pass pipe controlled by a valve that closes when power is applied to the ESP.

4. The system according to claim 1, wherein the stiffening arrangement and the load limiting arrangement together comprise a common structure.

5. The system according to claim 1, wherein the flowline jumper is orientated in a position that is within 5 degrees of horizontal.

6. The system according to claim 1, wherein the buoyancy elements comprise syntactic foam.

7. The system according to claim 1, wherein the buoyancy elements comprise at least one of a gas-filled tank, a buoyancy material filled tank, a gas filled pipe parallel to and arranged to the flowline jumper, and a buoyancy material filled pipe parallel to and arranged to the flowline jumper.

8. A system for subsea pumping or compressing, comprising:

a flowline jumper;

an ESP (electrical submersible pump) arranged in the flowline jumper;

a connector part in either end of the flowline jumper; and at least one of a truss structure and a longitudinal rib-arrangement configured as a stiffening arrangement to ensure a straight ESP shaft during lifting, installation, and operation;

wherein the stiffening arrangement comprises the longitudinal rib-arrangement.

9. The system according to claim 8, wherein the flowline jumper is orientated in a position that is within 5 degrees of horizontal.

10. The system according to claim 8, further comprising a load limiting arrangement that comprises buoyancy elements.

11. A system for subsea pumping or compressing, comprising:

a flowline jumper;

an ESP (electrical submersible pump) arranged in the flowline jumper;

a connector part in either end of the flowline jumper;

at least one of a truss structure and a longitudinal rib-arrangement configured as a stiffening arrangement to ensure a straight ESP shaft during lifting, installation, and operation; and at least one extendable support leg configured to extend toward the sea-bottom.

12. The system according to claim 11, wherein the flowline jumper is orientated in a position that is within 5 degrees of horizontal.

13. The system according to claim 11, further comprising a load limiting arrangement that comprises buoyancy elements.

14. A system for subsea pumping or compressing, comprising:

a flowline jumper;

an ESP (electrical submersible pump) arranged in the flowline jumper;

a connector part in either end of the flowline jumper;

at least one of a truss structure and a longitudinal rib-arrangement configured as a stiffening arrangement to ensure a straight ESP shaft during lifting, installation, and operation; and an intermediate landing structure that can be mounted at locations where the flowline jumper in which the ESP is arranged needs to be at an angle compared to a separate flowline jumper to allow enough space for installation.

15. The system according to claim 14, wherein the intermediate landing structure has been adapted for installation of more than one flowline jumper, each flowline jumper comprising an ESP arranged therein.

16. The system according to claim 15, wherein the intermediate landing structure comprises manifolds and valves allowing routing of flow through the ESPs.

17. The system according to claim 16, wherein the intermediate landing structure comprises manifolds and valves allowing at least two ESPs to be run in parallel.

18. The system according to claim 16, wherein the intermediate landing structure comprises manifolds and valves allowing at least two ESPs to be run in series.

19. The system according to claim 16, wherein the intermediate landing structure comprises manifolds and valves for a by-pass pipe.

20. The system according to claim 16, wherein the intermediate landing structure comprises remotely activated valves.

* * * * *